US012144426B2

(12) United States Patent
Kent

(10) Patent No.: US 12,144,426 B2
(45) Date of Patent: Nov. 19, 2024

(54) FOLDABLE AND PORTABLE CHAIR AND TABLE COMBINATION AND METHODS OF USING THE SAME

(71) Applicant: Kristin Kent, Concord, NC (US)

(72) Inventor: Kristin Kent, Concord, NC (US)

( * ) Notice: Subject to any disclaimer, the term of this patent is extended or adjusted under 35 U.S.C. 154(b) by 0 days.

(21) Appl. No.: 18/458,414

(22) Filed: Aug. 30, 2023

(65) Prior Publication Data

US 2024/0074589 A1 Mar. 7, 2024

Related U.S. Application Data

(60) Provisional application No. 63/403,416, filed on Sep. 2, 2022.

(51) Int. Cl.

| | |
|---|---|
| ***A47C 13/00*** | (2006.01) |
| ***A47B 3/14*** | (2006.01) |
| ***A47B 83/02*** | (2006.01) |
| ***A47C 4/04*** | (2006.01) |
| ***A47C 7/68*** | (2006.01) |
| ***A47C 7/70*** | (2006.01) |
| *A47C 4/08* | (2006.01) |
| *A47C 4/18* | (2006.01) |

(52) U.S. Cl.

CPC ..... *A47C 13/00* (2013.01); *A47B 83/02* (2013.01); *A47C 4/04* (2013.01); *A47C 7/68* (2013.01); *A47C 7/70* (2013.01); *A47C 4/08* (2013.01); *A47C 4/18* (2013.01)

(58) Field of Classification Search

CPC .. A47C 13/00; A47C 4/04; A47C 7/68; A47C 7/70; A47C 4/08; A47C 4/18; A47C 7/62; A47B 83/02

USPC ..... 297/1, 2, 16.2, 19, 23, 55, 56, 124–126, 297/113, 446.1, 447.1, 188.04

See application file for complete search history.

(56) References Cited

U.S. PATENT DOCUMENTS

| | | | | | |
|---|---|---|---|---|---|
| 365,698 | A | * | 6/1887 | Merkel | A47C 7/70 297/126 |
| 427,413 | A | * | 5/1890 | Fritz | A47B 83/02 297/126 |
| 1,310,250 | A | * | 7/1919 | Rogers | A47C 7/70 297/126 |
| 1,948,387 | A | * | 2/1934 | Levy | A47C 4/38 297/126 |
| 2,550,811 | A | * | 5/1951 | Ignatius | A47C 13/00 297/124 |

(Continued)

FOREIGN PATENT DOCUMENTS

| | | | | | |
|---|---|---|---|---|---|
| DE | 929272 | C | * | 6/1955 | A47D 11/002 |
| FR | 2579436 | A1 | * | 10/1986 | |
| GB | 2160767 | A | * | 1/1986 | A47B 83/02 |

OTHER PUBLICATIONS 2 page PDF of translation of DE 929272C. (Year: 1955).*

*Primary Examiner* — Robert Canfield

(74) *Attorney, Agent, or Firm* — Stanek Lemon Crouse & Meeks, PA

(57) ABSTRACT

Embodiments of the present inventive concept provide a chair and tabletop assembly including a foldable frame wherein the foldable frame includes an upper component including a tabletop panel wherein the upper component and the tabletop panel are adapted to facilitate the chair and tabletop assembly to exhibit one of a chair configuration, or a combined chair and table or desk configuration.

4 Claims, 19 Drawing Sheets

(56) References Cited

U.S. PATENT DOCUMENTS

| | | | | | |
|---|---|---|---|---|---|
| 2,702,584 | A * | 2/1955 | Williams | A47C 13/00 | 297/440.16 |
| 2,758,633 | A * | 8/1956 | Apple | A47C 13/00 | 297/448.1 |
| 2,897,876 | A * | 8/1959 | Austin | A47C 7/70 | 297/31 |
| 3,367,712 | A * | 2/1968 | Greene | A47C 13/00 | 182/33.3 |
| 4,322,109 | A * | 3/1982 | Thebaud | A47C 7/405 | 108/118 |
| 4,801,175 | A * | 1/1989 | Albanese | A47C 13/00 | 297/124 |
| 6,189,965 | B1 * | 2/2001 | Hecht | A47C 7/70 | 297/124 |
| 6,659,543 | B2 * | 12/2003 | McCutcheon | A47B 85/04 | 297/127 |
| 6,883,863 | B2 * | 4/2005 | Ginns | A47C 7/70 | 297/354.11 |
| 8,720,990 | B2 * | 5/2014 | Boydston | A47C 7/70 | 297/173 |
| 10,588,408 | B1 * | 3/2020 | Meeks | A47B 87/002 | |
| 2002/0140257 | A1 * | 10/2002 | Liu | A47C 11/00 | 297/124 |
| 2023/0263303 | A1 * | 8/2023 | Oligee | A47B 85/04 | 297/124 |

* cited by examiner

FOLDABLE AND PORTABLE CHAIR AND TABLE COMBINATION AND METHODS OF USING THE SAME

CROSS-REFERENCE TO RELATED APPLICATIONS

This application claims priority to U.S. Provisional Application No. 63/403,416, filed Sep. 2, 2022, the content of which is hereby incorporated herein in its entirety.

BACKGROUND

Currently, portable furniture is designed for one purpose. For example, foldable and portable chairs are widely available. However, there are times in which a single-purpose article of portable furniture is limiting. For example, if a tabletop is needed, clip-on tabletops exist that can be used as a second part to a portable chair. However, in this example, it is inconvenient to carry separate pieces to provide both a portable chair and portable table function.

SUMMARY

The subject matter of the present inventive concept provides a foldable and portable chair and table combination and methods of using the same.

In some embodiments, the presently disclosed foldable and portable chair and table combination and methods provide an article of multi-purpose furniture featuring a foldable frame that may be (1) folded or collapsed for easy carrying and/or stowing, (2) folded to provide a chair only configuration, which is a seating position, and (3) folded to provide a chair and tabletop (or desktop) configuration, which is a desk and chair position.

The chair-table assembly of the present inventive concept provides a surface for the placement of items that are needed while the user is in a seated position.

BRIEF DESCRIPTION OF DRAWINGS

Figure 1:
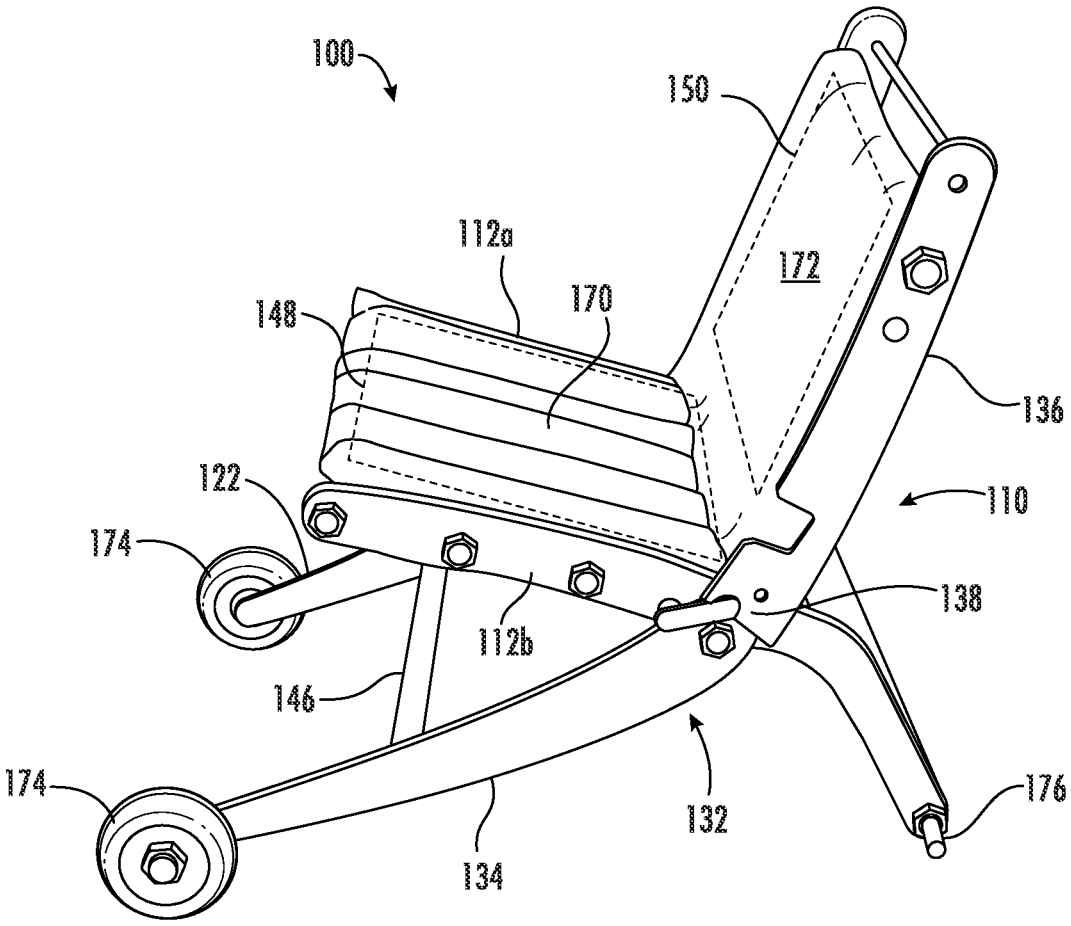
Figure 2:
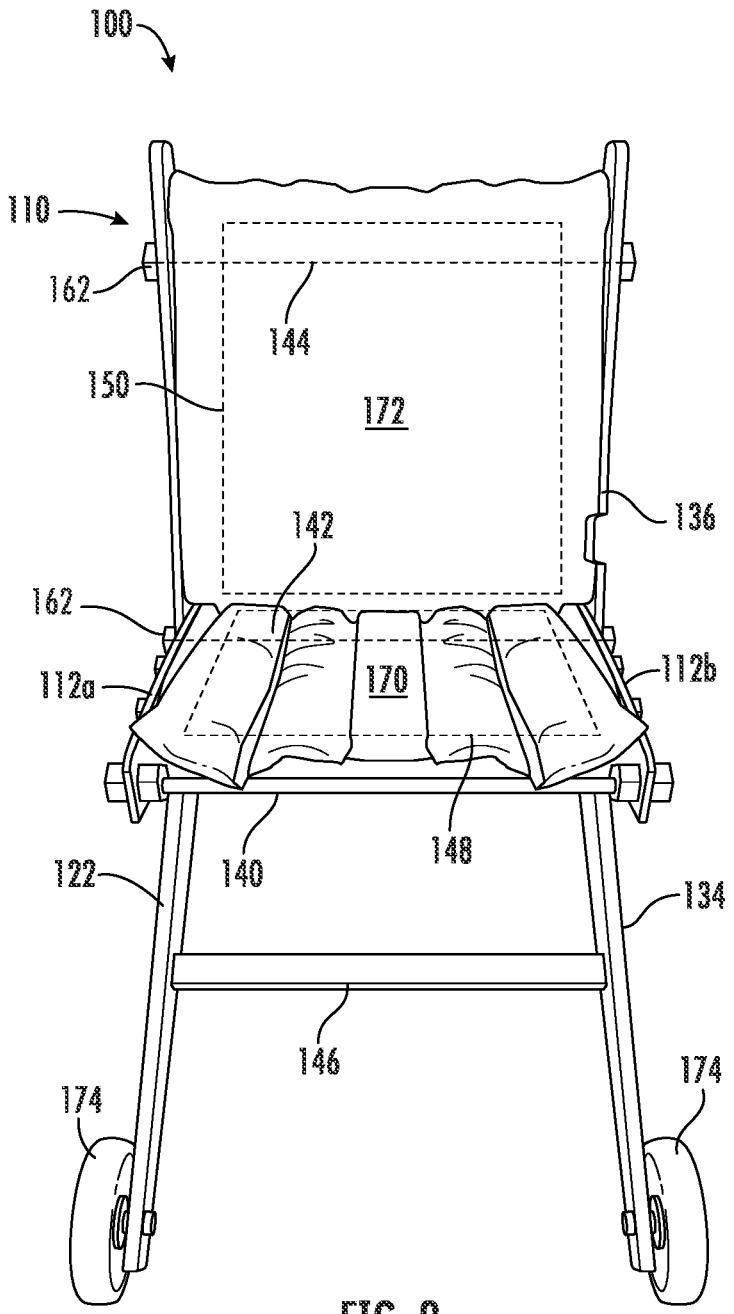
Figure 3:
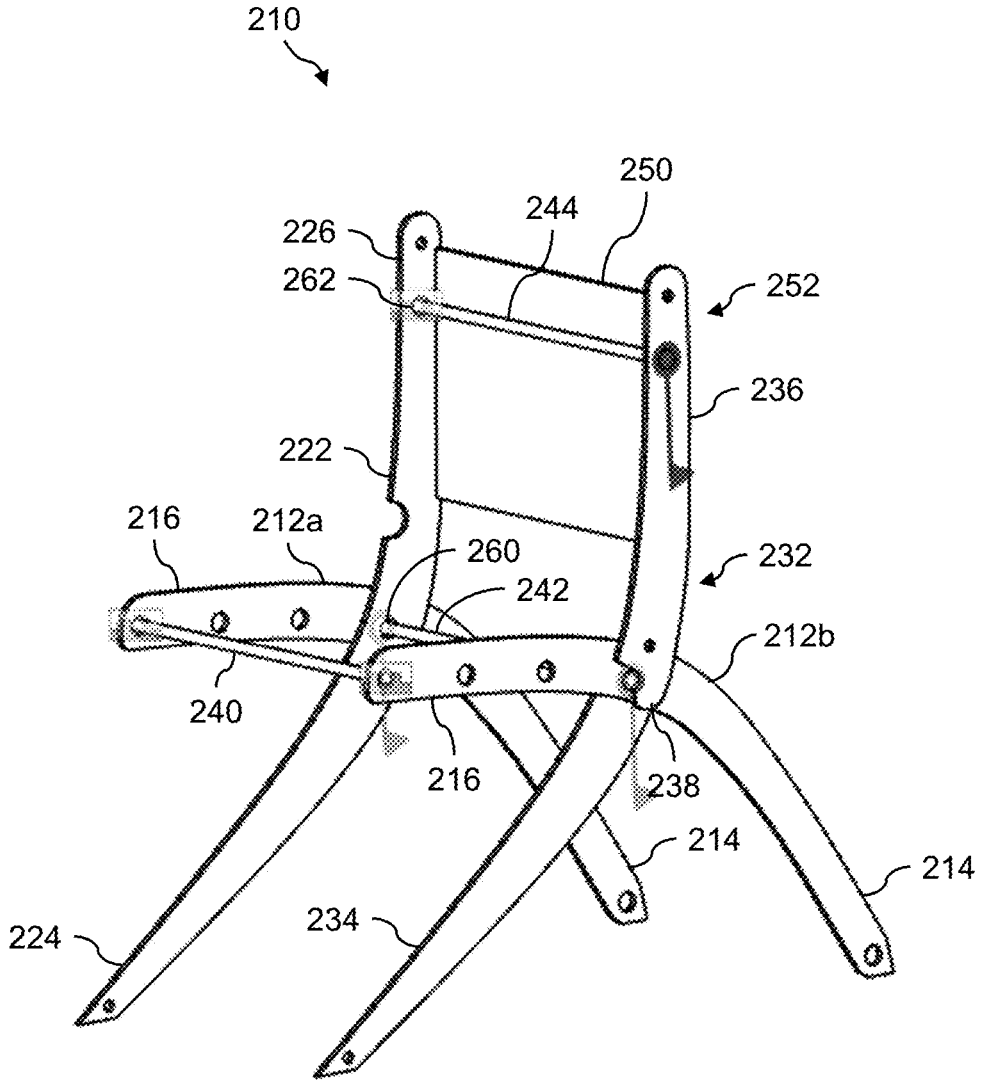
Figure 4:
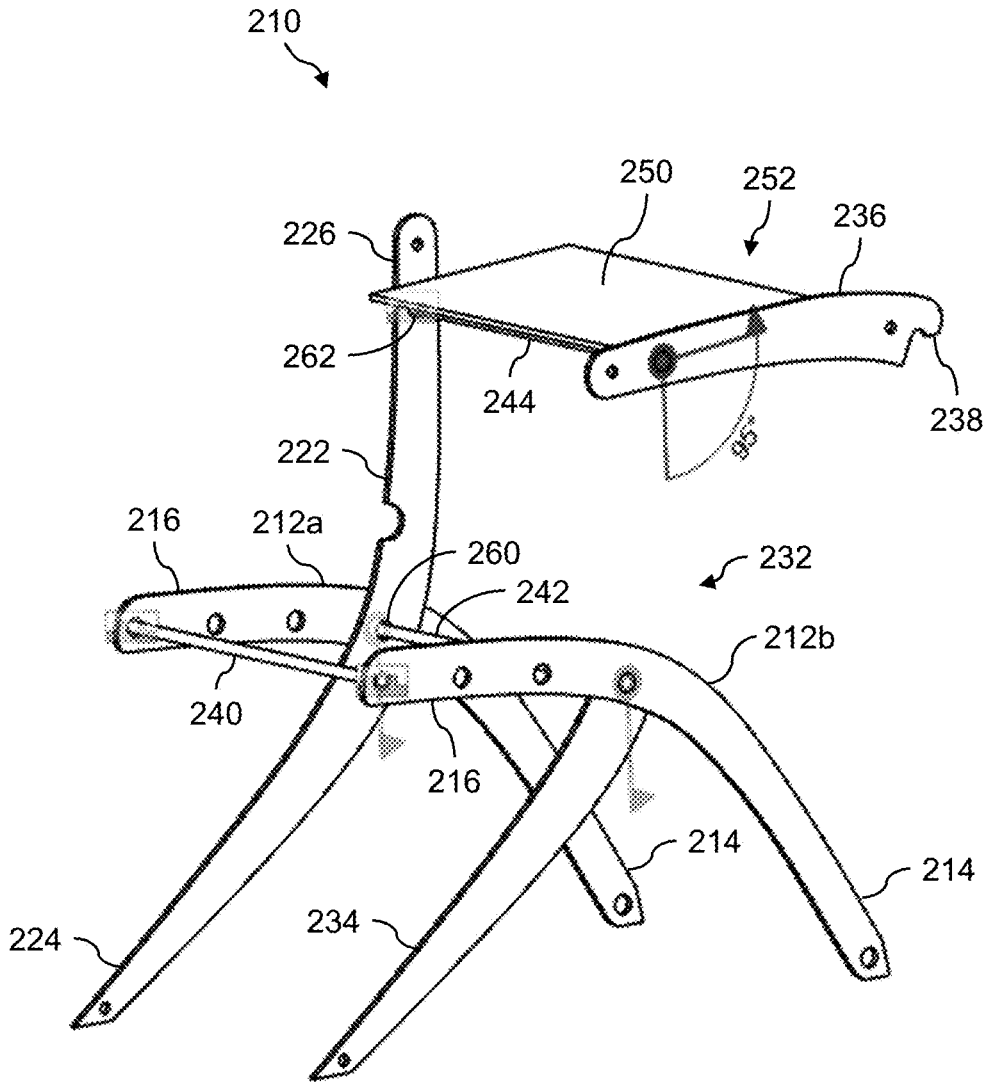
Figure 5A:
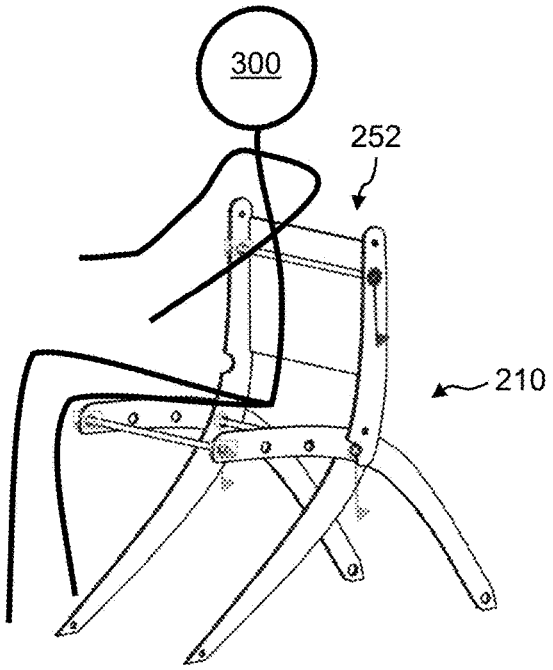
Figure 5B:
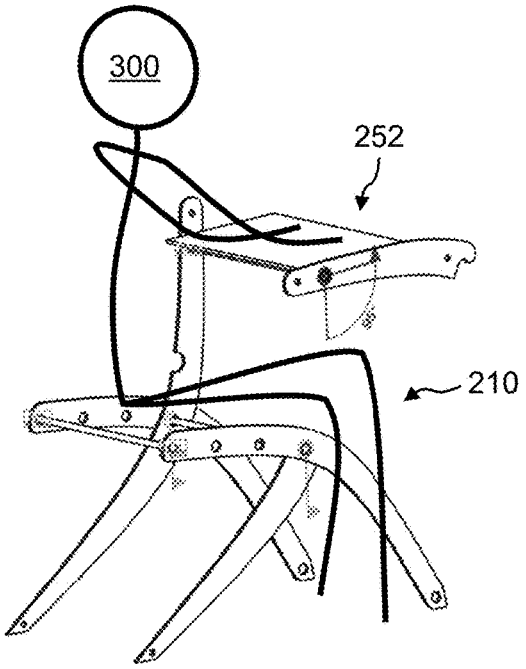
Figure 6:
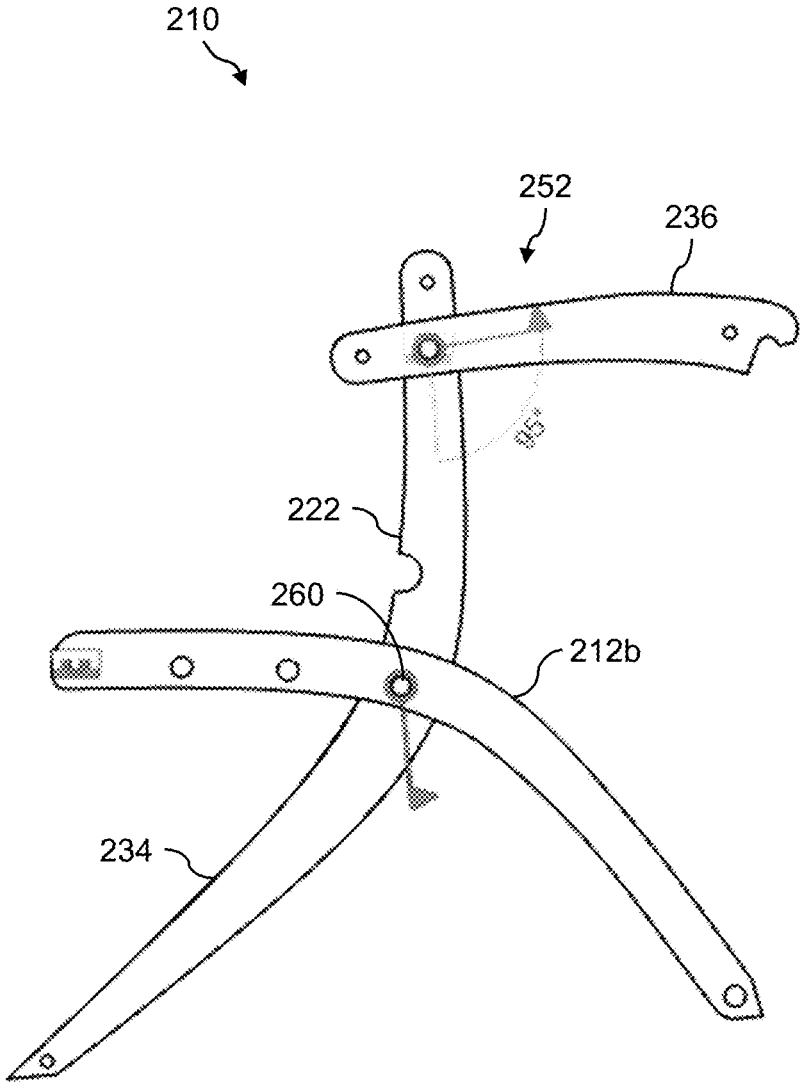
Figure 7:
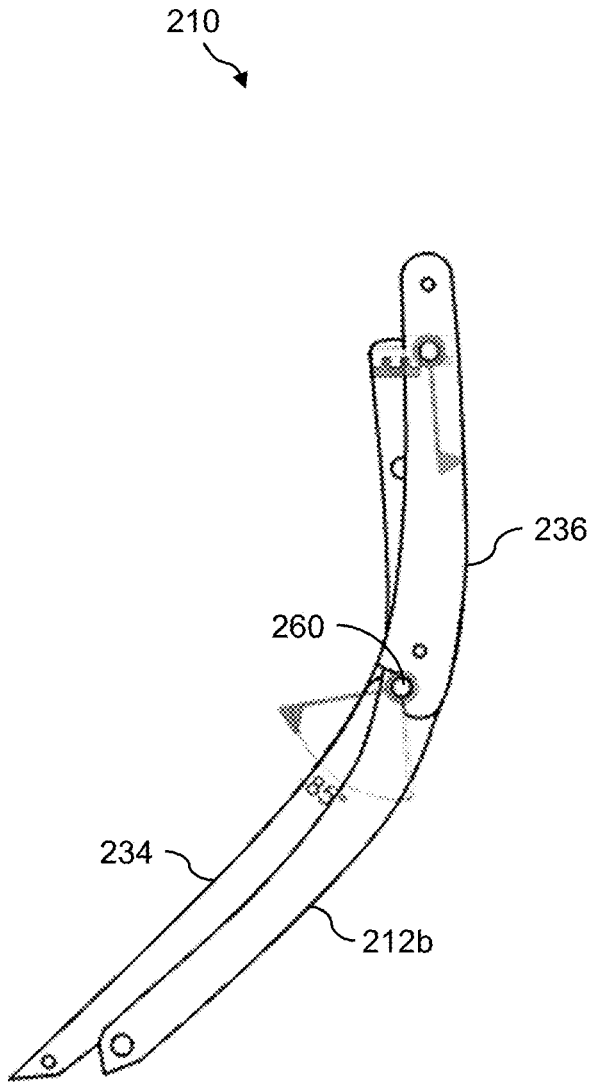
Figure 8:
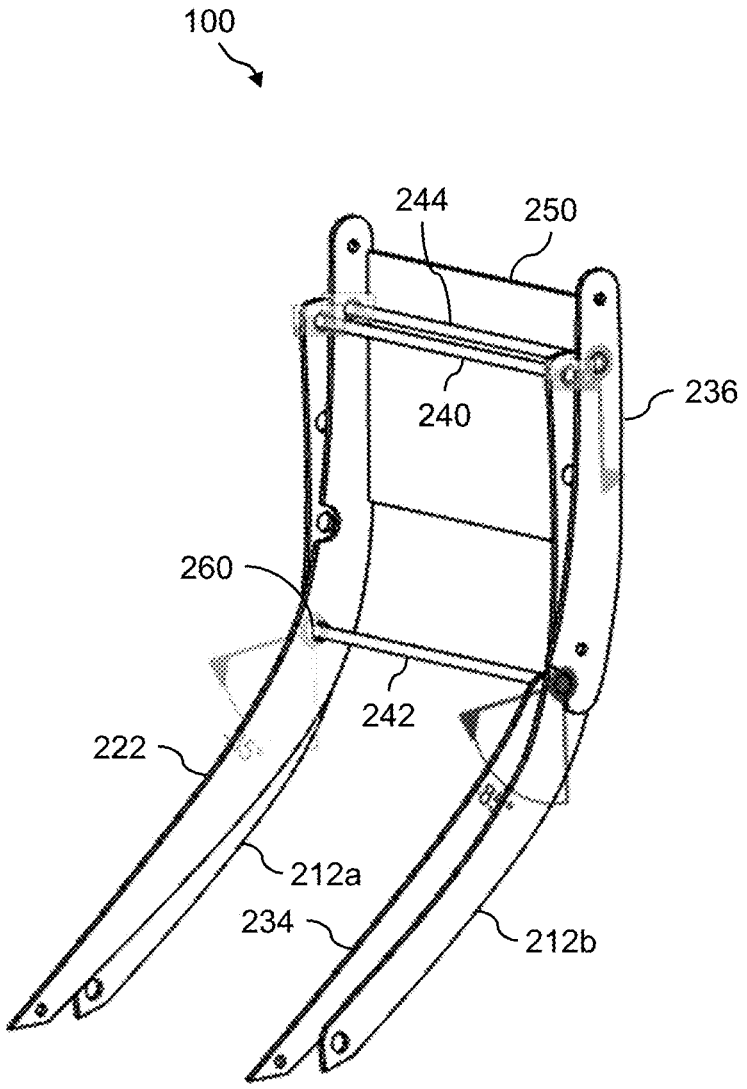
Figure 10A:
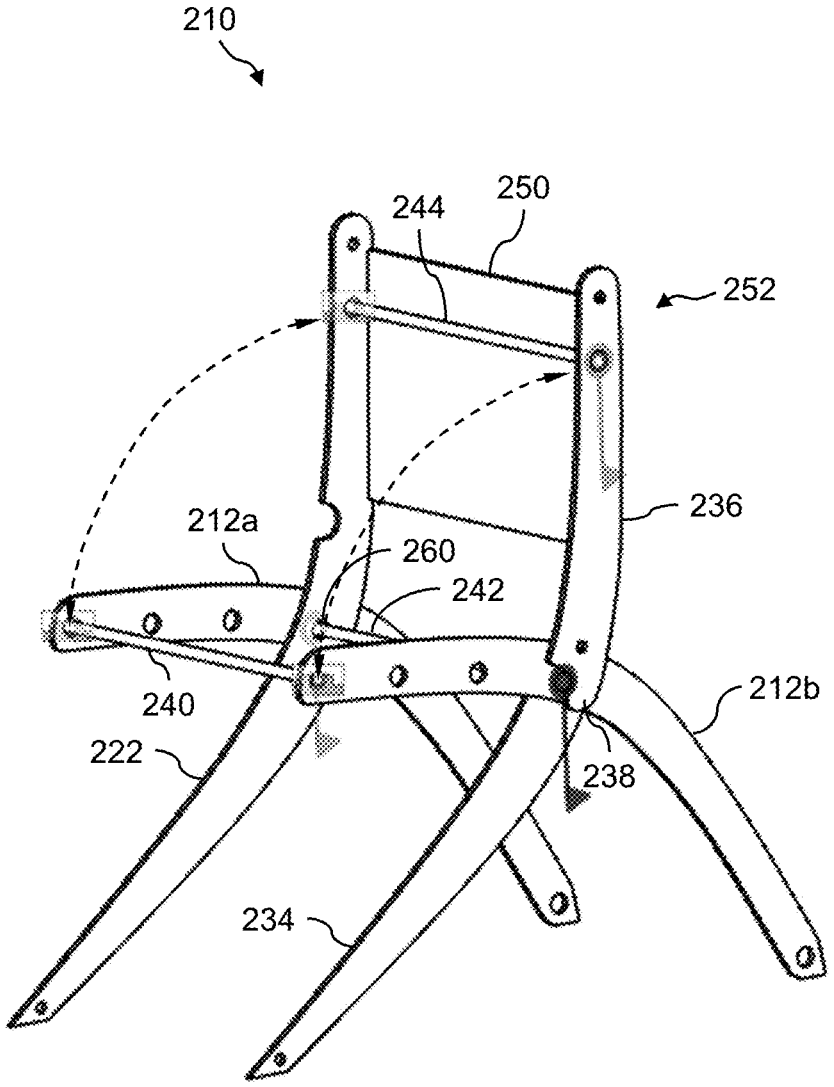
Figure 10B:
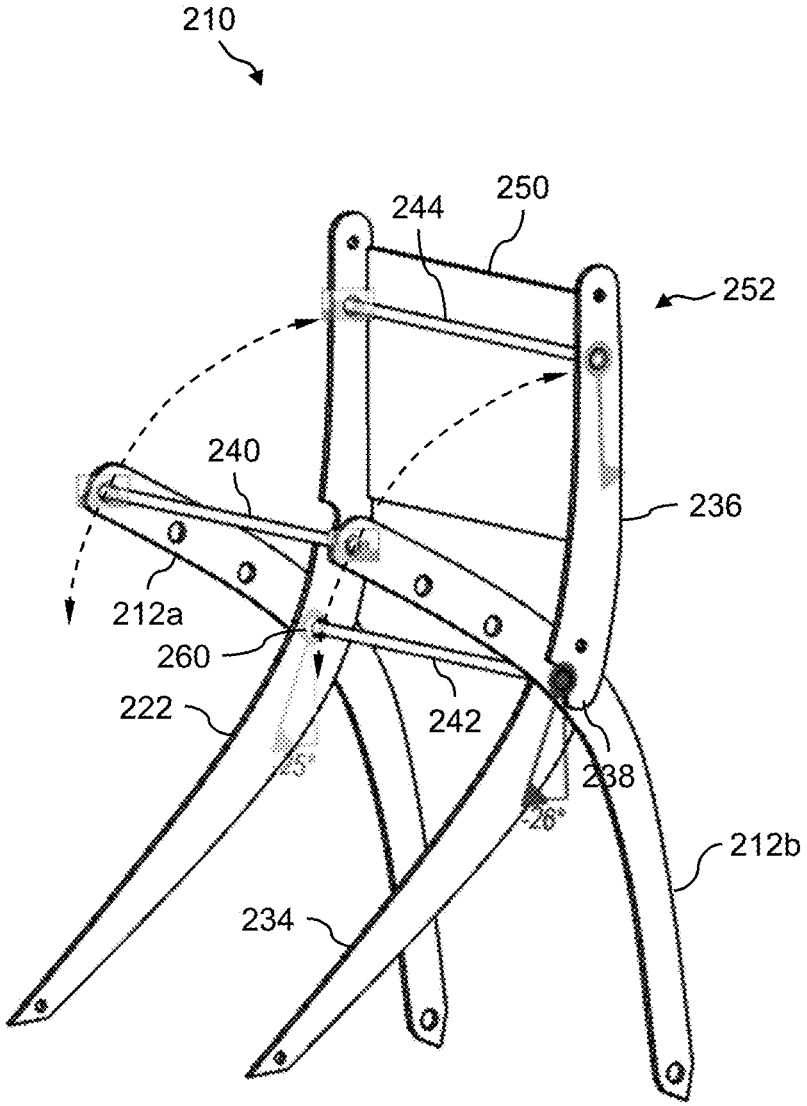
Figure 10C:
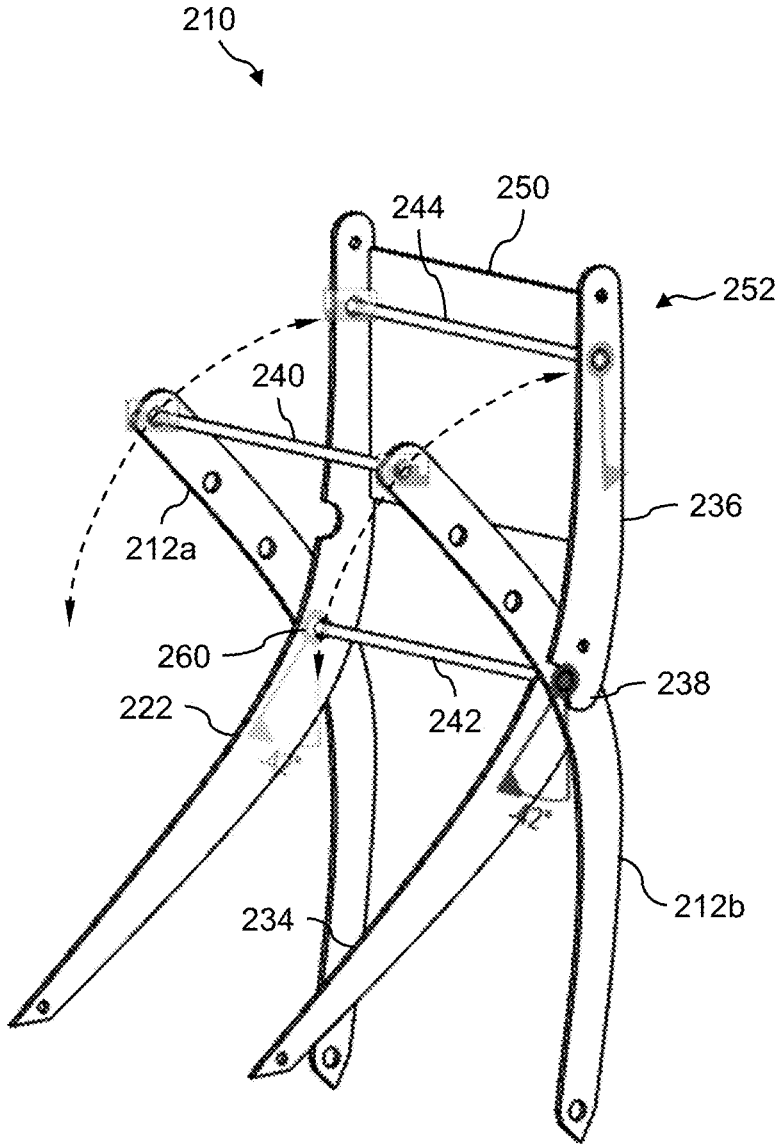
Figure 10D:
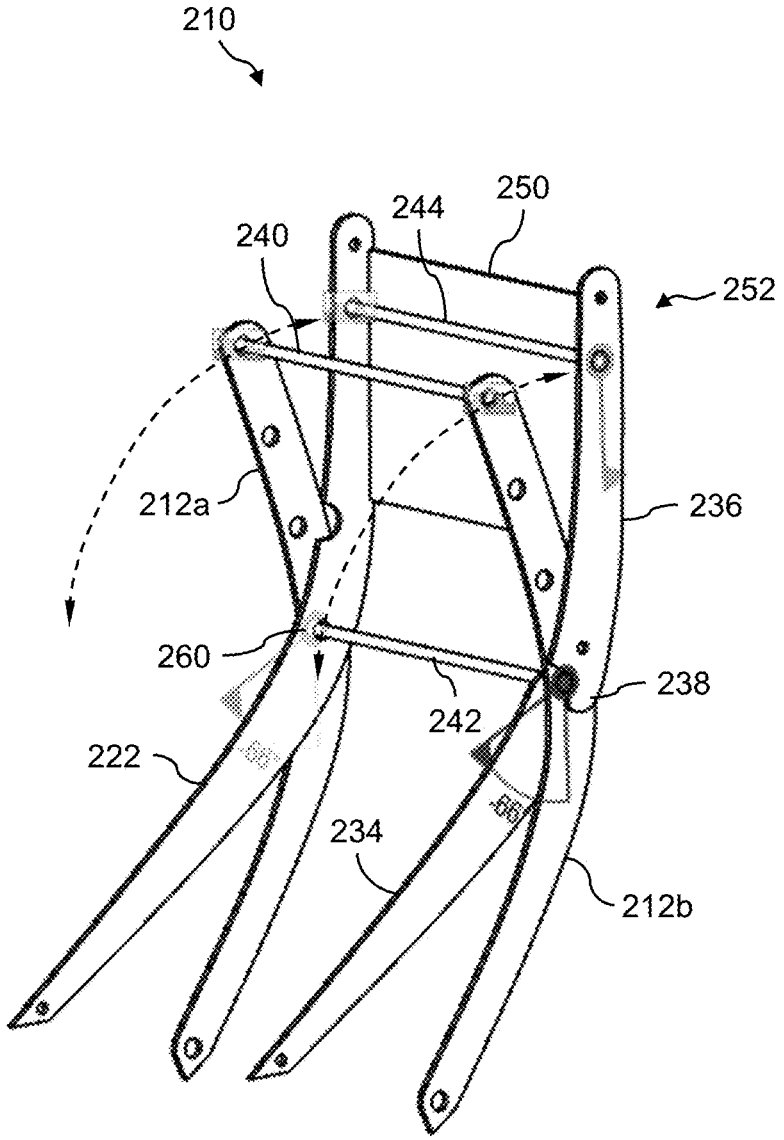
Figure 10E:
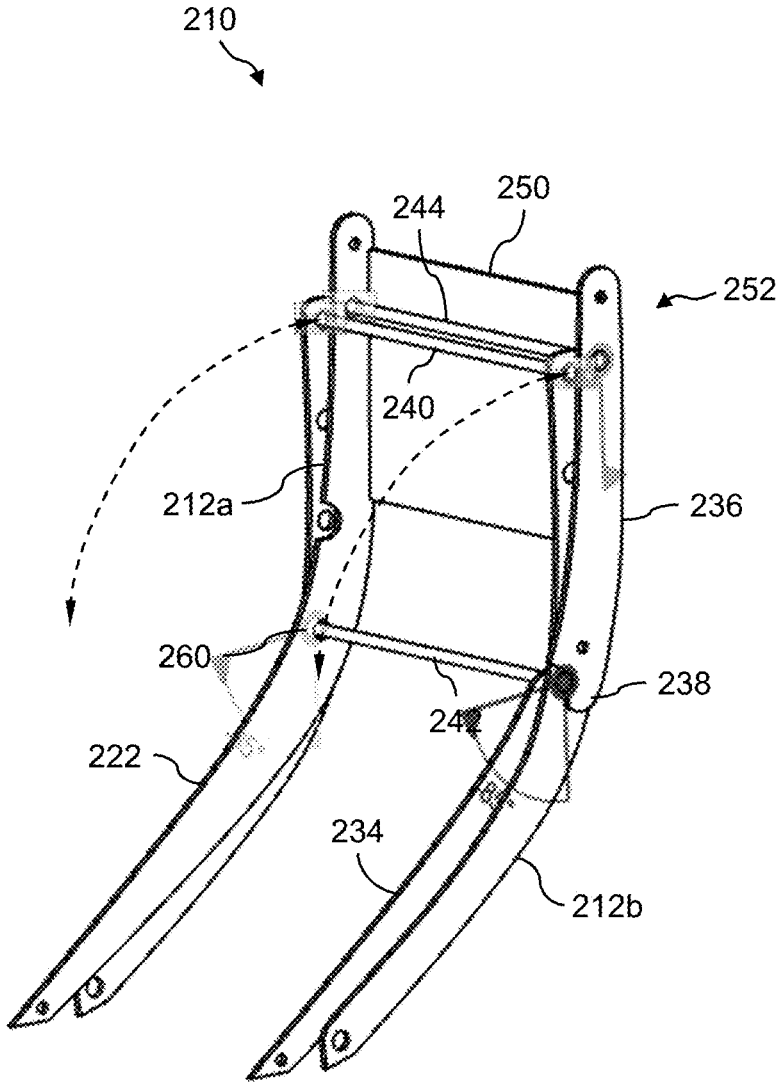
Figure 11:
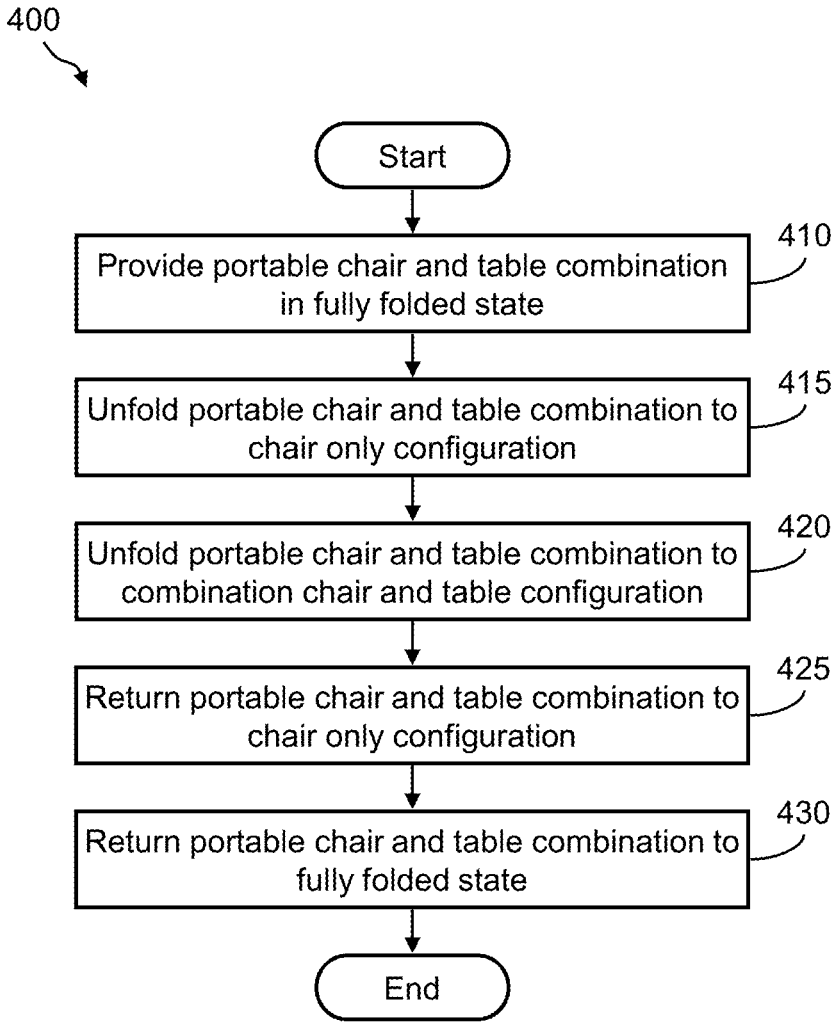

Having thus described the subject matter of the present invention in general terms, reference will now be made to the accompanying drawings, which are not necessarily drawn to scale, and wherein:

FIG. 1 and FIG. 2 show photos of an example of a foldable and portable chair and table combination, in accordance with an embodiment of the invention;

FIG. 3 illustrates a perspective view of another example of a foldable frame of the chair and table combination and wherein the foldable frame is in the chair only configuration, in accordance with an embodiment of the invention;

FIG. 4 illustrates a perspective view of the foldable frame shown in FIG. 3 and wherein the foldable frame is in the combination chair and table configuration, in accordance with an embodiment of the invention;

FIG. 5A illustrates a perspective view of an example of a user in relation to the chair and table combination when in the chair only configuration;

FIG. 5B illustrates a perspective view of an example of a user in relation to the chair and table combination when in the combination chair and table configuration;

FIG. 6 illustrates a side view of the foldable frame shown in FIG. 3 and FIG. 4 when in the fully open or unfolded state;

FIG. 7 and FIG. 8 illustrate a side view and a perspective view, respectively, of the foldable frame shown in FIG. 3 and FIG. 4 when in the fully closed or folded state;

FIG. 9A through FIG. 9E illustrate perspective views showing an example of a process of transitioning the foldable frame shown in FIG. 3 and FIG. 4 from the chair only configuration to the combination chair and table configuration;

FIG. 10A through FIG. 10E illustrate perspective views showing an example of a process of transitioning the foldable frame shown in FIG. 3 and FIG. 4 from the chair only configuration to the fully closed or folded state; and FIG. 11 illustrates a flow diagram of an example of a method of using the foldable and portable chair and table combination, in accordance with an embodiment of the invention.

DETAILED DESCRIPTION

The subject matter of the present invention now will be described more fully hereinafter with reference to the accompanying drawings, in which some, but not all embodiments of the subject matter of the present invention are shown. Like numbers refer to like elements throughout. The subject matter of the present invention may be embodied in many different forms and should not be construed as limited to the embodiments set forth herein; rather, these embodiments are provided so that this disclosure will satisfy applicable legal requirements. Indeed, many modifications and other embodiments of the subject matter of the present invention set forth herein will come to mind to one skilled in the art to which the subject matter of the present invention pertains having the benefit of the teachings presented in the foregoing descriptions and the associated drawings. Therefore, it is to be understood that the subject matter of the present invention is not to be limited to the specific embodiments disclosed and that modifications and other embodiments are intended to be included within the scope of the appended claims.

Following long-standing patent law convention, the terms "a," "an," and "the" refer to "one or more" when used in this application, including the claims. Thus, for example, reference to "a subject" includes a plurality of subjects, unless the context clearly is to the contrary (e.g., a plurality of subjects), and so forth.

Throughout this specification and the claims, the terms "comprise," "comprises," and "comprising" are used in a non-exclusive sense, except where the context requires otherwise. Likewise, the term "include" and its grammatical variants are intended to be non-limiting, such that recitation of items in a list is not to the exclusion of other like items that can be substituted or added to the listed items. Moreover, it should be noted that the chair and tabletop assembly may comprise, consist essentially of, or consist of the various components described herein.

For the purposes of this specification and appended claims, unless otherwise indicated, all numbers expressing amounts, sizes, dimensions, proportions, shapes, formulations, parameters, percentages, quantities, characteristics, and other numerical values used in the specification and claims, are to be understood as being modified in all instances by the term "about" even though the term "about" may not expressly appear with the value, amount or range. Accordingly, unless indicated to the contrary, the numerical parameters set forth in the following specification and attached claims are not and need not be exact but may be approximate and/or larger or smaller as desired, reflecting tolerances, conversion factors, rounding off, measurement error and the like, and other factors known to those of skill in the art depending on the desired properties sought to be obtained by the subject matter of the present invention. For example, the term "about," when referring to a value can be meant to encompass variations of, in some embodiments ±100%, in some embodiments ±50%, in some embodiments ±20%, in some embodiments ±10%, in some embodiments ±5%, in some embodiments ±1%, in some embodiments ±0.5%, and in some embodiments ±0.1% from the specified amount, as such variations are appropriate to perform the disclosed methods or employ the disclosed compositions.

Further, the term "about" when used in connection with one or more numbers or numerical ranges, should be understood to refer to all such numbers, including all numbers in a range and modifies that range by extending the boundaries above and below the numerical values set forth. The recitation of numerical ranges by endpoints includes all numbers, e.g., whole integers, including fractions thereof, subsumed within that range (for example, the recitation of 1 to 5 includes 1, 2, 3, 4, and 5, as well as fractions thereof, e.g., 1.5, 2.25, 3.75, 4.1, and the like) and any range within that range.

In some embodiments, the subject matter of the present inventive concept provides a foldable and portable chair and table combination and methods of using the same. In some embodiments, the chair-table assembly of the present inventive concept can be used to provide a surface for the placement of items that are needed while the user is in a seated position. For example, the portable chair and table combination can be used in medical facilities such as hospitals, skilled nursing facilities, temporary medical or health sites such as clinics, health fairs, etc. to help deliver medicines, vaccines, assess vital signs, conduct diagnostic tests, etc. The foldable and portable chair and table combination can be used in educational and/or religious environments, for example, but not limited to being used as a desk or a prayer setting. Moreover, the chair-table assembly can be used in indoor or outdoor dining, recreational and/or entertainment settings.

In some embodiments, the presently disclosed foldable and portable chair and table combination and methods provide an article of multi-purpose furniture featuring a foldable frame that may be (1) folded or collapsed for easy carrying and/or stowing, (2) folded to provide a chair only configuration, which is a seating position, and (3) folded to provide a chair and tabletop (or desktop) configuration, which is a desk and chair position.

Referring now to FIG. 1 and FIG. 2 are visuals of an example of a foldable and portable chair and table combination 100, in accordance with an embodiment of the invention. Chair and table combination 100 may be, for example, a foldable and portable article of multi-purpose furniture. For example, in one configuration, chair and table combination 100 may provide a basic chair (see FIG. 5A). Then, in another configuration of chair and table combination 100, the backrest of the basic chair may transform into a tabletop (or desktop) that allows users to flip around in the seat and have a desk to use (see FIG. 5B). In yet another configuration, chair and table combination 100 may be folded up or collapsed for easy carrying and/or stowing. By way of example, FIG. 1 and FIG. 2 shows chair and table combination 100 in the basic chair configuration only. However, FIG. 3 through FIG. 10E show other configurations of chair and table combination 100.

In one example, chair and table combination 100 may include a foldable frame 110 for supporting a seat bottom cushion 170 and a seat back cushion 172. In one example, seat bottom cushion 170 and seat back cushion 172 may be separate cushions. In another example, seat bottom cushion 170 and seat back cushion 172 may be hinged together to form a one-piece unit.

In one example, foldable frame 110 may include a pair of seat side rails 112*a* and 112*b*, a seat back side rail 122, and a segmented seat back side rail 132 including a lower segment 134 and an upper segment 136. Further, a latch 138 may be provided where the end of lower segment 134 meets the end of upper segment 136. Additionally, as shown in FIG. 2, a forward rod 140, a rear rod 142, and an upper rod 144 are arranged between and supporting the two seat side rails 112*a* and 112*b* and the seat back side rail 122 and the segmented seat back side rail 132. Additionally, a seat panel 148 (not visible) may be supported by forward rod 140 and a rear rod 142. Further, a tabletop panel 150 (not visible) may be supported by upper rod 144. Additionally, foldable frame 110 may include any other supports 146. In this configuration, tabletop panel 150 (not visible) provides the backrest.

Additionally, to facilitate the folding action of chair and table combination 100, a pivot point 160 is provided at and enabled by rear rod 142. Further, a pivot point 162 at seat back side rail 122 is provided and enabled by upper rod 144. For example, a tabletop assembly 152 (not visible) may include upper rod 144, tabletop panel 150, and upper segment 136 of segmented seat back side rail 132 and wherein upper rod 144 of tabletop assembly 152 may pivot at pivot point 162 at seat back side rail 122.

Optionally, a wheel 174 may be provided at the front foot portion of seat back side rail 122. Likewise, another a wheel 174 may be provided at the front foot portion of lower segment 134 of segmented seat back side rail 132. Further, in this example, the rear foot portions of seat side rails 112*a* and 112*b* may be brought together in bending fashion to substantially a single point to rest on the ground and to provide a handle 176.

The members forming foldable frame 110 of chair and table combination 100 may be formed of any rigid and strong materials and sized suitable to support the weight of a person using chair and table combination 100. Additionally, the materials forming foldable frame 110 may be suitably lightweight for easy portability. For example, the members of foldable frame 110 may be formed of aluminum, steel, stainless steel, metal alloys, plastic, and the like, and any combinations thereof. The foldable and portable chair and table combination can be any size to accommodate the user. For example, the assembly may accommodate a child or an adult of various heights and weight.

Referring now to FIG. 3 is a perspective view of another example of a foldable frame 210 of chair and table combination 100 and wherein the foldable frame 210 is in the chair only configuration. Further, FIG. 4 is a perspective view of foldable frame 210 shown in FIG. 3 and wherein the foldable frame 210 is in the combination chair and table configuration.

In one example and referring still to FIG. 3 and FIG. 4, foldable frame 210 may include a pair of seat side rails 212*a* and 212*b*, a seat back side rail 222, and a segmented seat back side rail 232 including a lower segment 234 and an upper segment 236. Further, seat back side rail 222 may include a lower foot portion 224 and an upper portion 226. Further, a latch 238 may be provided where the end of lower segment 234 meets the end of upper segment 236. Additionally, a forward rod 240, a rear rod 242, and an upper rod 244 are arranged between and supporting the two seat side rails 212*a* and 212*b* and the seat back side rail 222 and the segmented seat back side rail 232. Additionally, a seat panel 248 (not shown) may be supported by forward rod 240 and a rear rod 242. Further, a tabletop panel 250 may be supported by upper rod 244.

Additionally, to facilitate the folding action of foldable frame 210, a pivot point 260 is provided at and enabled by rear rod 242. Further, a pivot point 262 at seat back side rail 222 is provided and enabled by upper rod 244. For example, a tabletop assembly 252 may include upper rod 244, tabletop panel 250, and upper segment 236 of segmented seat back side rail 232 and wherein upper rod 244 of tabletop assembly 252 may pivot at pivot point 262 at seat back side rail 222.

Further, latch 238 at the end of lower segment 234 may be, for example, a stile latch (not shown) that holds tabletop assembly 252 in the backrest position when foldable frame 210 is in the seating position. Additionally, a pivoting stile (not shown) may be provided at seat back side rail 222 and at pivot point 262. The pivoting stile (not shown) may provide the locking mechanism for holding tabletop assembly 252 in the desk and chair position.

Further, in this example, seat side rails 212*a* and 212*b* remain separate and are not brought together in bending fashion as is the case with seat side rails 112*a* and 112*b* of foldable frame 110 shown in FIG. 1 and FIG. 2.

The members forming foldable frame 210 of chair and table combination 100 may be formed of any rigid and strong materials and sized suitable to support the weight of a person using chair and table combination 100. Additionally, the materials forming foldable frame 210 may be suitably lightweight for easy portability. For example, the members of foldable frame 210 may be formed of aluminum, steel, stainless steel, metal alloys, plastic, and the like, and any combinations thereof.

Referring now to FIG. 5A is a perspective view of an example of a user 300 in relation to foldable frame 210 of chair and table combination 100 when in the chair only configuration. In this configuration, foldable frame 210 provides a basic chair in which user 300 may sit facing forward. In this configuration, tabletop panel 250 of tabletop assembly 252 provides the backrest.

Referring now to FIG. 5B is a perspective view of an example of a user in relation to foldable frame 210 of chair and table combination 100 when in the combination chair and table configuration. In this configuration, foldable frame 210 provides a chair and tabletop (or desktop) combination in which user 300 may sit facing backward compared with the user 300 shown in FIG. 5A in order to use tabletop assembly 252 as, for example, a desk. In this configuration, tabletop assembly 252 with tabletop panel 250 provides the desktop function.

Further to the example, FIG. 6 show a side view of foldable frame 210 shown in FIG. 3 and FIG. 4 when in the fully open or unfolded state. Additionally, FIG. 7 and FIG. 8 show a side view and a perspective view, respectively, of foldable frame 210 shown in FIG. 3 and FIG. 4 when in the fully closed or folded state for carrying and/or stowing.

Figure 9A:
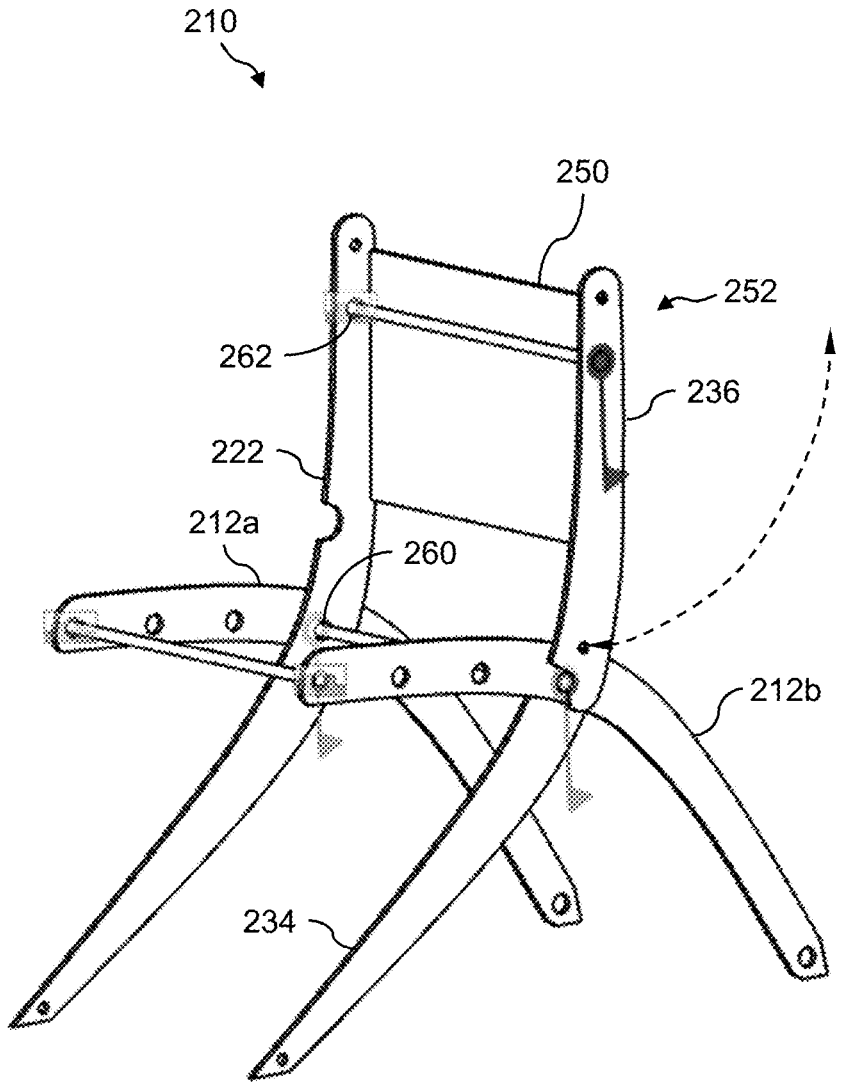
Figure 9B:
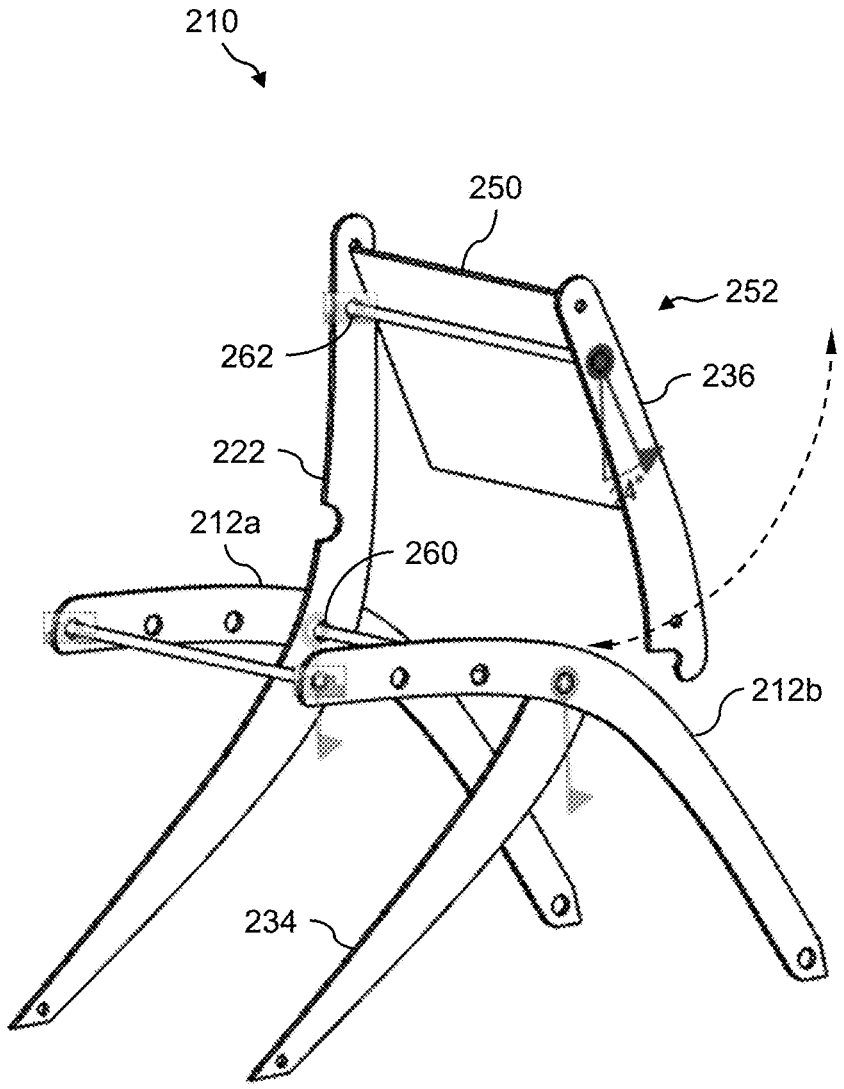
Figure 9C:
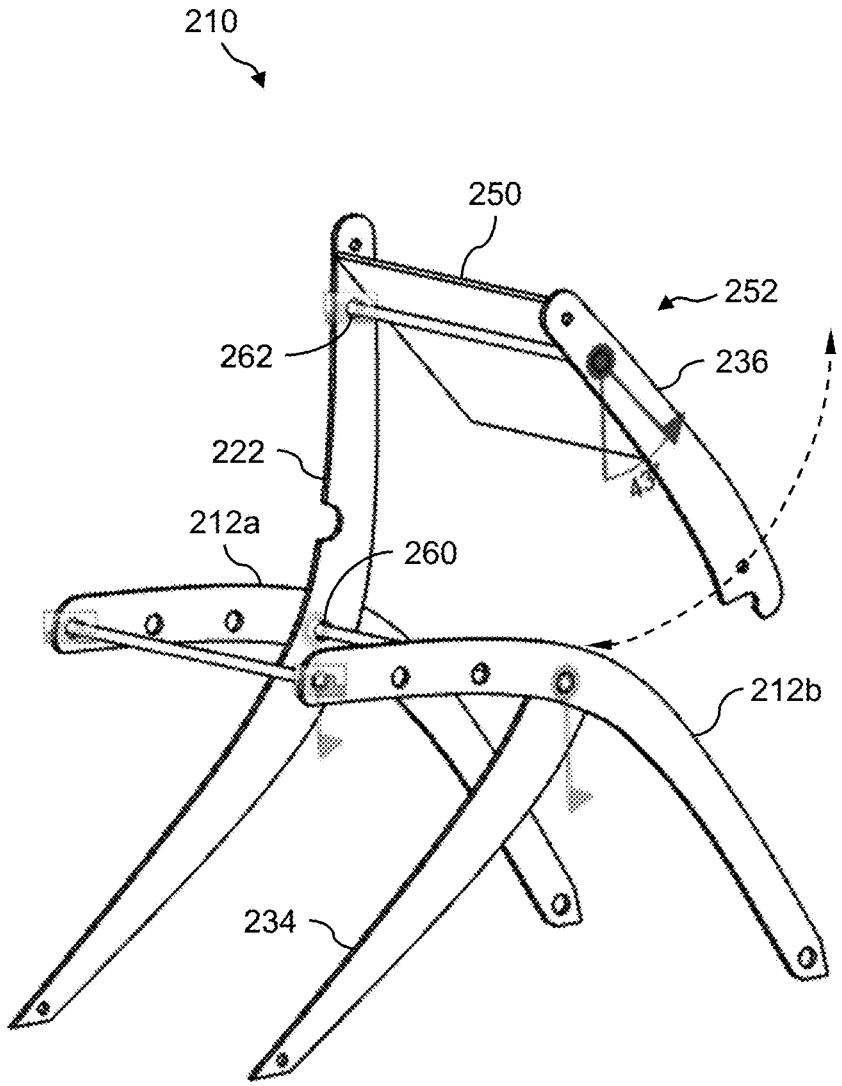
Figure 9D:
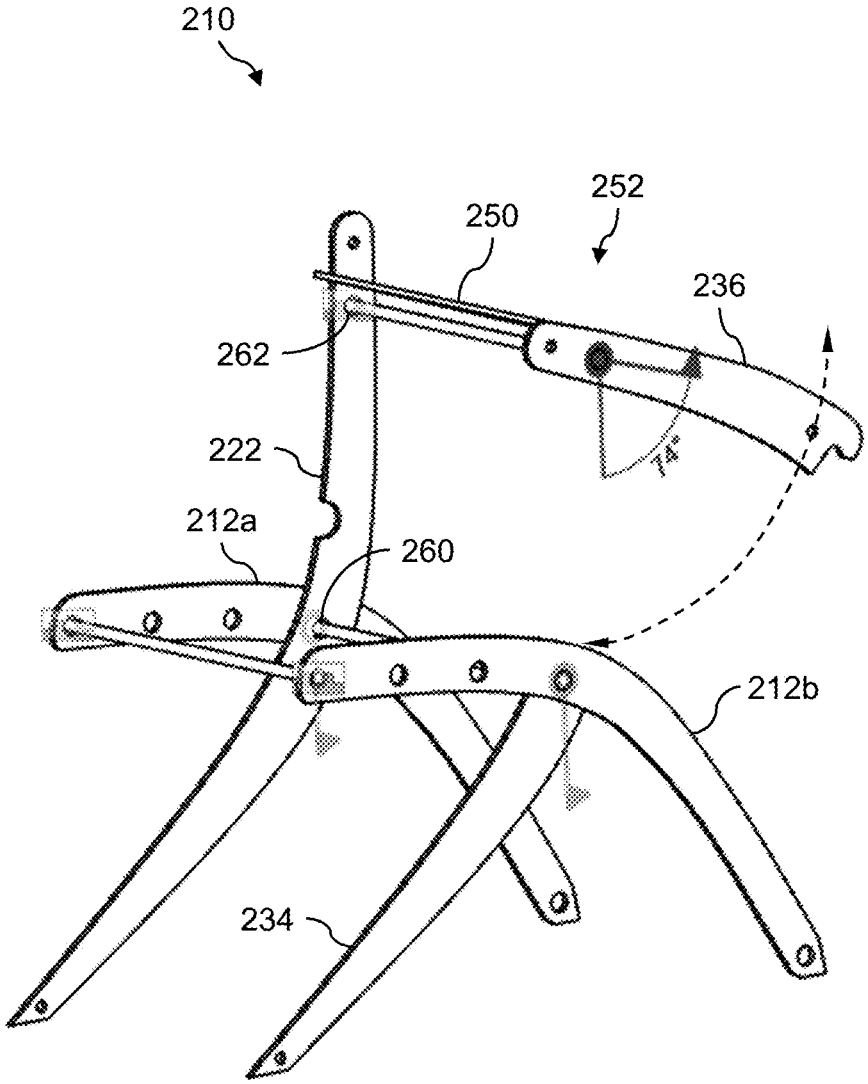
Figure 9E:
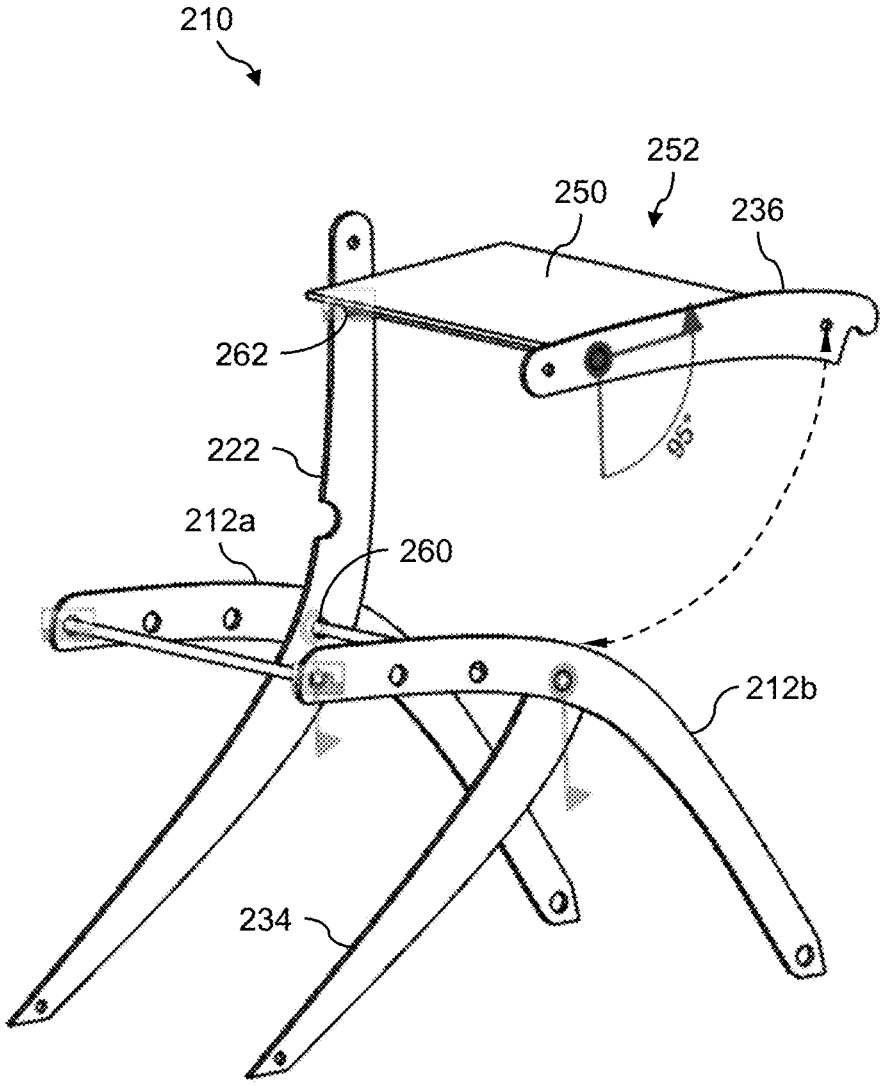

Referring now to FIG. 9A through FIG. 9E is perspective views showing an example of a process of transitioning foldable frame 210 from the chair only configuration to the combination chair and table configuration. For example, FIG. 9A shows tabletop assembly 252 fully in the backrest or seating position. Then, FIG. 9B shows tabletop assembly 252 pivoting toward the desk and chair position. Then, FIG. 9C shows tabletop assembly 252 pivoting further toward the desk and chair position. Then, FIG. 9D shows tabletop assembly 252 pivoting yet further toward the desk and chair position. Then, FIG. 9E shows tabletop assembly 252 fully in the desk and chair position.

The main feature of portable chair and table combination 100 compared with conventional folding chairs (or furniture) is that, for example, foldable frame 210 includes a pivoting stile/back-post that transforms tabletop panel 250 of tabletop assembly 252 from the backrest into a tabletop. This includes one stationary stile at the end of upper rod 244 that meets upper segment 236 of segmented seat back side rail 232. While at the same time, the other end of upper rod 244 provides a hinged cross rail that connects to a pivoting stile at upper portion 226 of seat back side rail 222, which is pivot point 262. The pivoting stile is fixed into a conventional seating form via a latch connecting seat back side rail 222 and upper rod 244 to the stile. When the latch is released the pivoting stile and tabletop assembly 252 swing upwards into a tabletop or desk and chair position.

Referring now to FIG. 10A through FIG. 10E is perspective views showing an example of a process of transitioning foldable frame 210 from the chair only configuration to the fully closed or folded state. For example, FIG. 10A shows foldable frame 210 configured fully in the chair only or seating position. Then, FIG. 10B shows the seat side rails 212*a* and 212*b* (i.e., the seat bottom) pivoting toward tabletop assembly 252, which is in the backrest position. Then, FIG. 10C shows the seat side rails (i.e., the seat bottom) pivoting further toward tabletop assembly 252. Then, FIG. 10D shows the seat side rails 212*a* and 212*b* pivoting yet further toward tabletop assembly 252. Then, FIG. 10E shows foldable frame 210 in the fully collapsed position for easy carrying and/or stowing.

Referring now to FIG. 11 is a flow diagram of an example of a method 400 of using the presently disclosed foldable and portable chair and table combination 100, in accordance with an embodiment of the invention. Method 400 may include, but is not limited to, the following steps.

At a step 410, a portable chair and table combination is provided in the fully folded state. For example, portable chair and table combination 100 shown in FIG. 1 and FIG. 2 may be provided in the fully folded state. In one example, portable chair and table combination 100 may include foldable frame 110 as shown in FIG. 1 and FIG. 2. In another example, portable chair and table combination 100 may include foldable frame 210 as shown in FIG. 3 through FIG. 10E. An example of foldable frame 210 in the fully folded state is shown in FIG. 7, FIG. 8, and FIG. 10E.

At a step 415, the portable chair and table combination is unfolded to the chair only configuration. For example, portable chair and table combination 100 is unfolded to the chair only configuration or seating position. An example of portable chair and table combination 100 in the seating position is shown in FIG. 1 and FIG. 2 and in FIG. 5A. Additionally, FIG. 10E, then FIG. 10D, then FIG. 10C, then FIG. 10B, and then FIG. 10A show a process of unfolding portable chair and table combination 100 from the fully closed or folded state to the seating position.

At a step 420, the portable chair and table combination is further unfolded to the combination chair and table configuration. For example, portable chair and table combination 100 is further unfolded to the combination chair and table configuration or desk and chair position. An example of portable chair and table combination 100 in the desk and chair position is shown in FIG. 4 and in FIG. 5A. Additionally, FIG. 9A, then FIG. 9B, then FIG. 9C, then FIG. 9D, and then FIG. 9E show a process of further unfolding portable chair and table combination 100 from the seating position to the combination chair and table configuration or desk and chair position.

At a step 425, the portable chair and table combination is returned to the chair only configuration. For example, the portable chair and table combination 100 in the desk and chair position is returned to the seating position as shown, for example, in FIG. 9E, then FIG. 9D, then FIG. 9C, then FIG. 9B, and then FIG. 9A.

At a step 430, the portable chair and table combination is returned to the fully folded state. For example, the portable chair and table combination 100 is returned to the fully folded state. For example, the portable chair and table combination 100 in the seating position is returned to the fully folded state as shown, for example, in FIG. 10A, then FIG. 10B, then FIG. 10C, then FIG. 10D, and then FIG. 10E.

In summary and referring now to FIG. 1 through FIG. 11, the presently disclosed foldable and portable chair and table combination 100 and method 400 provide an article of multi-purpose furniture featuring a foldable frame (e.g., foldable frame 110, 210) that may be (1) folded or collapsed for easy carrying and/or stowing (see FIG. 7 and FIG. 8), (2) folded to provide a chair only configuration, which is a seating position (see FIG. 5A), and (3) folded to provide a chair and tabletop (or desktop) configuration, which is a desk and chair position (see FIG. 5B).

Optional features of the foldable and portable chair and table combination or accessories associated therewith include, but are not limited to, a basket, umbrella, cup holder, visor, pouch, lights, fan, monitor, speaker, outlet, e.g., USB, heating mechanism, cooling mechanism, pillow, head rest, neck rest, arm rest, foot rest, massage capabilities, blanket, a sterile table top surface, accessory to attach multiple chairs, a device to pull multiple chairs, covering to protect the chair and table assembly.

Although the foregoing subject matter has been described in some detail by way of illustration and example for purposes of clarity of understanding, it will be understood by those skilled in the art that certain changes and modifications can be practiced within the scope of the appended claims.

The invention claimed is:

1. A chair and tabletop assembly comprising:

a foldable frame wherein the foldable frame comprises an upper segment comprising a tabletop panel wherein the upper segment and the tabletop panel are adapted to facilitate the chair and tabletop assembly to exhibit one of a chair configuration or a combined chair and tabletop configuration, wherein the tabletop panel in the chair configuration provides a backrest to a person, and the tabletop panel in the combined chair and tabletop assembly configuration provides a desktop to the person, wherein the foldable frame further comprises a latch that is disposed at the upper segment, wherein a seat back side rail further comprises a lower segment that meets the upper segment such that the latch is provided at an end of the upper segment that meets an end of the lower segment when the chair and tabletop assembly exhibits the chair configuration, and wherein the latch is adapted to hold the tabletop assembly when the chair and table combination exhibits the chair configuration and the latch is further adapted to disengage with the end of the lower segment when the chair and tabletop assembly exhibits the combined chair and tabletop configuration, wherein the foldable frame further comprises a first seat side rail arranged parallel to a second seat side rail, and wherein the foldable frame further comprises a front rod and a rear rod wherein the front rod and the rear rod are disposed between the first side seat side rail and the second seat side rail. wherein the front rod and the rear rod facilitate the person to sit in one of the chair configuration and in the combined chair and tabletop configuration, wherein the person faces in a first direction while sitting in the chair configuration and the person faces in a second direction while sitting in the combined chair and tabletop configuration such that the second direction is opposite to the first direction, wherein the foldable frame further comprises a second pivot point wherein the seat side rails are pivoted about the second pivot point and away from the tabletop panel to facilitate the chair and tabletop assembly to exhibit a fully unfolded state.

2. The chair and tabletop assembly of claim 1, wherein the foldable frame further comprises:

a seatback side rail arranged parallel to the seat back side rail, wherein the seatback side rail comprises a lower foot portion arranged parallel to the lower segment; and an upper portion arranged parallel to the upper segment.

3. The chair and tabletop assembly of claim 2, wherein the foldable frame further comprises an upper rod that is disposed between the upper portion and the upper segment wherein the upper rod supports the tabletop panel.

4. A chair and tabletop assembly comprising:

a foldable frame wherein the foldable frame comprises an upper segment comprising a tabletop panel wherein the upper segment and the tabletop panel are adapted to facilitate the chair and tabletop assembly to exhibit one of a chair configuration or a combined chair and tabletop configuration, wherein the tabletop panel in the chair configuration provides a backrest to a person, and the tabletop panel in the combined chair and tabletop assembly configuration provides a desktop to the person, wherein the foldable frame further comprises a latch that is disposed at the upper segment, wherein a seat back side rail further comprises a lower segment that meets the upper segment such that the latch is provided at an end of the upper segment that meets an end of the lower segment when the chair and tabletop assembly exhibits the chair configuration, and wherein the latch is adapted to hold the tabletop assembly when the chair and table combination exhibits the chair configuration and the latch is further adapted to disengage with the end of the lower segment when the chair and tabletop assembly exhibits the combined chair and tabletop configuration, wherein the foldable frame further comprises a first seat side rail arranged parallel to a second seat side rail, wherein the foldable frame further comprises a front rod and a rear rod wherein the front rod and the rear rod are disposed between the first side seat side rail and the second seat side rail, wherein the front rod and the rear rod facilitate the person to sit in one of the chair configuration and in the combined chair and tabletop configuration, wherein the person faces in a first direction while sitting in the chair configuration and the person faces in a second direction while sitting in the combined chair and tabletop configuration such that the second direction is opposite to the first direction, and wherein the foldable frame further comprises a second pivot point wherein the seat side rails are pivoted about the second pivot point and towards the tabletop panel to facilitate the chair and tabletop assembly to exhibit a fully folded state.

* * * * *